US007398712B1

(12) United States Patent
Hsieh

(10) Patent No.: US 7,398,712 B1
(45) Date of Patent: Jul. 15, 2008

(54) ROTARY IMPACT TOOL

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/653,475

(22) Filed: Mar. 14, 2007

(51) Int. Cl.
*B25B 23/16* (2006.01)

(52) U.S. Cl. ..... 81/177.5; 81/177.4; 81/492; 16/110 R

(58) Field of Classification Search ..... 81/177.1, 81/177.5, 451, 170, 492, 436, 453, 439, 438, 81/177.4, 490; 16/110 R, 441; 173/90; 227/147
See application file for complete search history.

(56) References Cited

U.S. PATENT DOCUMENTS 751,496 A * 2/1904 Gode ..... 16/441
1,049,650 A * 1/1913 Benjamin ..... 81/436
1,965,917 A * 7/1934 Anderholm ..... 7/167
2,985,209 A * 5/1961 Novelo ..... 81/177.1
4,093,008 A * 6/1978 Martin ..... 81/177.1
4,166,488 A * 9/1979 Irby ..... 81/28
4,763,548 A * 8/1988 Leibinger et al. ..... 81/453
5,265,504 A * 11/1993 Fruhm ..... 81/439
5,431,075 A * 7/1995 Cruz et al. ..... 81/492
5,526,724 A * 6/1996 Bruggeman ..... 81/492
5,638,727 A * 6/1997 Gringer ..... 81/438
5,749,271 A * 5/1998 Liu ..... 81/60
5,823,078 A * 10/1998 Liu ..... 81/436
6,032,557 A * 3/2000 Anderson ..... 81/451
6,089,130 A * 7/2000 Wu ..... 81/170
6,295,904 B1 * 10/2001 Webb ..... 81/492
6,378,402 B1 * 4/2002 Kalomeris et al. ..... 81/177.5

* cited by examiner

*Primary Examiner*—Scott A. Smith

(57) ABSTRACT

A rotary impact tool comprises a driving portion; an axial portion; a handle enclosing the axial portion; and an impact portion being pivotally installed to the axial portion and rotatable with respect to the axial portion; wherein the rotatable impact portion causes that the tool is an impact tool and a rotation tool. A magnetic unit is installed in the impact portion for absorption. A bottom end of the driving portion has a resisting portion which is an elliptical cylinder with two ends being cut. A body extended from the axial portion and the body is formed with a plurality of holes. The axial portion is formed with a through hole. A C ring encloses the axial portion; the axial portion is connected to the impact portion by using the C ring; and thus the impact portion is rotatable with respect to the axial portion.

6 Claims, 6 Drawing Sheets

ROTARY IMPACT TOOL

FIELD OF THE INVENTION

The present invention relates to impact tools, and particularly to a rotary impact tool which has a buffer effect for suffering from a great impact force and provides multiple functions for easy operations.

BACKGROUND OF THE INVENTION

One prior art impact tool has a first part, a second part, and a body. The first part has an engaging portion which has a penetrating through hole. The second part is made of a soft material which has an engaging hole for receiving the engaging portion of the first part. A front end of the body has an operation portion. The body can be engaged to a recess of the first part. The lower end of the body and the operation portion expose out of the first part. Thereby when the second part is held, since the second part is made of soft material and an operation portion resists against a work piece and a hammer collides a body, the vibration will be absorbed by an air chamber of the second part. Thereby the hand of the user will not be hurt.

However the structure of the prior impact tool is too simple and has unique function which is not suitable for current design concept of tools. The current design principle for tools requires that the tools have multiple functions so that one tool can perform several functions. Thereby a user only needs to carry one tool for several different operations. Further, the prior art impact tool has a short arm of force which is not suitable for driving a tighten engaged screwing object.

SUMMARY OF THE INVENTION

Accordingly, the primary object of the present invention is to provide a rotary impact tool which has a buffer effect for suffering from a great impact force and provides multiple functions for easy operations.

To achieve above objects, the present invention provides a rotary impact tool which comprises a driving portion; an axial portion; a handle enclosing the axial portion; and an impact portion being pivotally installed to the axial portion and rotatable with respect to the axial portion; wherein the rotatable impact portion causes that the tool is an impact tool and a rotation tool. A magnetic unit is installed in the impact portion for absorption. A bottom end of the driving portion has a resisting portion which is an elliptical cylinder with two ends being cut. A body extended from the axial portion and the body is formed with a plurality of holes. The axial portion is formed with a through hole. A C ring encloses the axial portion; the axial portion is connected to the impact portion by using the C ring; and thus the impact portion is rotatable with respect to the axial portion. The impact portion has an insertion unit and an insertion unit.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
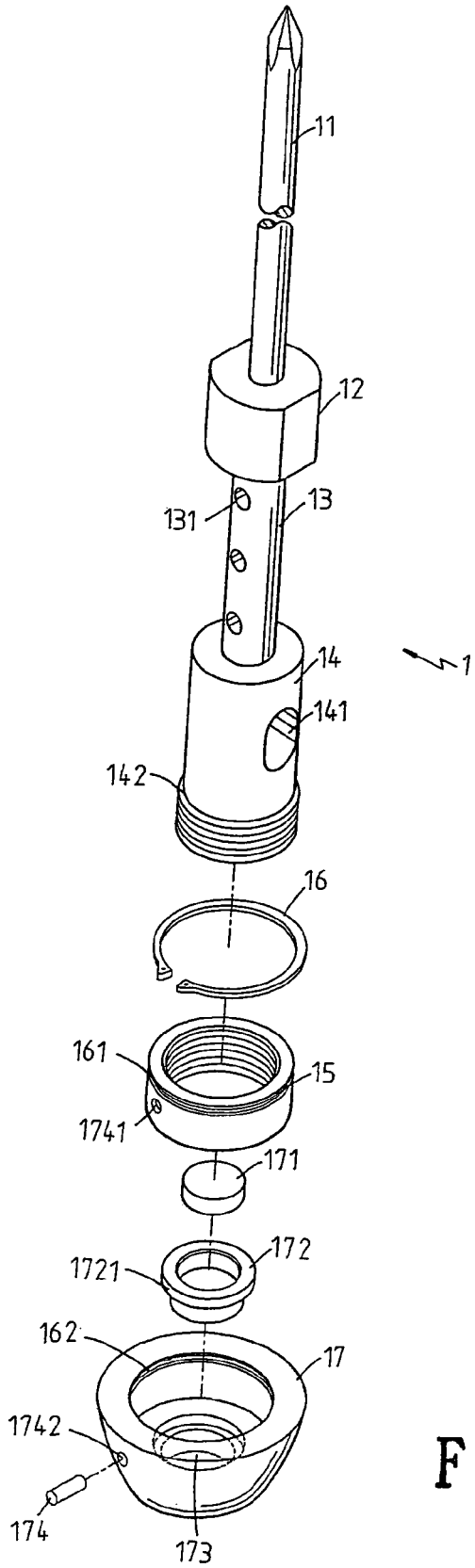
FIG. 1 is an explosive schematic view of the rotary impact tool of the present invention.

Referring to FIG. 1, the rotary impact tool 1 of the present invention is illustrated. The present invention has the following elements.

A driving portion 11 is extended with a resisting portion 12 at a lower side thereof. The resisting portion 12 is an elliptical cylinder with two cut ends.

A body 13 extends from a lower side of the resisting portion 12. An axial size of the body 13 is smaller than that of the resisting portion 12. The body 13 has a plurality of via holes 131.

An axial portion 14 extends from a lower side of the body 13. A through hole 141 is formed in the axial portion 14. A lower periphery of the axial portion 14 is formed with a thread portion 142 for engaging with an engaging unit 15. The engaging unit 15 is formed with a first recess 161 for buckling with a C ring 16 so as to be combined with an impact portion 17. A lateral side of the engaging unit 15 is formed with a first insertion hole 1741 for receiving an insertion unit 174. A lower side of the impact portion 17 is formed with a receiving hole 173. A stop unit 172 is received in the receiving hole 173. A magnetic unit 171 is received in the stop unit 172. A lateral side of the impact portion 17 is formed with a second insertion hole 1742. An insertion unit 174 is received in the second insertion hole 1742.

In assembly, the axial portion 14 is screwed to the engaging unit 15. The C ring 16 encloses the first recess 161 of the engaging unit 15.

The magnetic unit 171 is received in the stop unit 172. A flange 1721 extends from an upper periphery of the stop unit 172 resisting against an inner wall of the receiving hole 173 of the impact portion 17 so that the magnetic unit 171 will not protrude out from the receiving hole 173.

An upper inner wall of the impact portion 17 is formed with the second recess 162. The impact portion 17 is rotatable with respect to the engaging unit 15. The engaging unit 15 is combined with the axial portion 14 so that the impact portion 17 is rotatale with respect to the axial portion 14 to form a pivotal rotatable impact portion 17.

Furthermore, the engaging unit 15 has a first insertion hole 1741. The impact portion 17 has a second insertion hole 1742 and an insertion unit 174. When the present invention is assembled, while the impact portion 17 is not installed, the engaging unit 15 is screwed to the thread portion 142 of the axial portion 14. By the C ring 16 enclosing the engaging unit 15, the impact portion 17 is rotatable with respect to the engaging unit 15. When the insertion unit 174 is received in the second insertion hole 1742 of the impact portion 17, the impact portion 17 passes through the second insertion hole 1742 to be assembled to the first insertion hole 1741 so that the impact portion 17 is combined with the engaging unit 15. Moreover, when the engaging unit 15 is screwed to the axial portion 14, if the user rotates the impact portion 17 and thus the engaging unit 15 rotates, the engaging unit 15, magnetic unit 171, stop unit 172, C ring 16 and the impact portion 17 can be screwed and detached.

Figure 2:
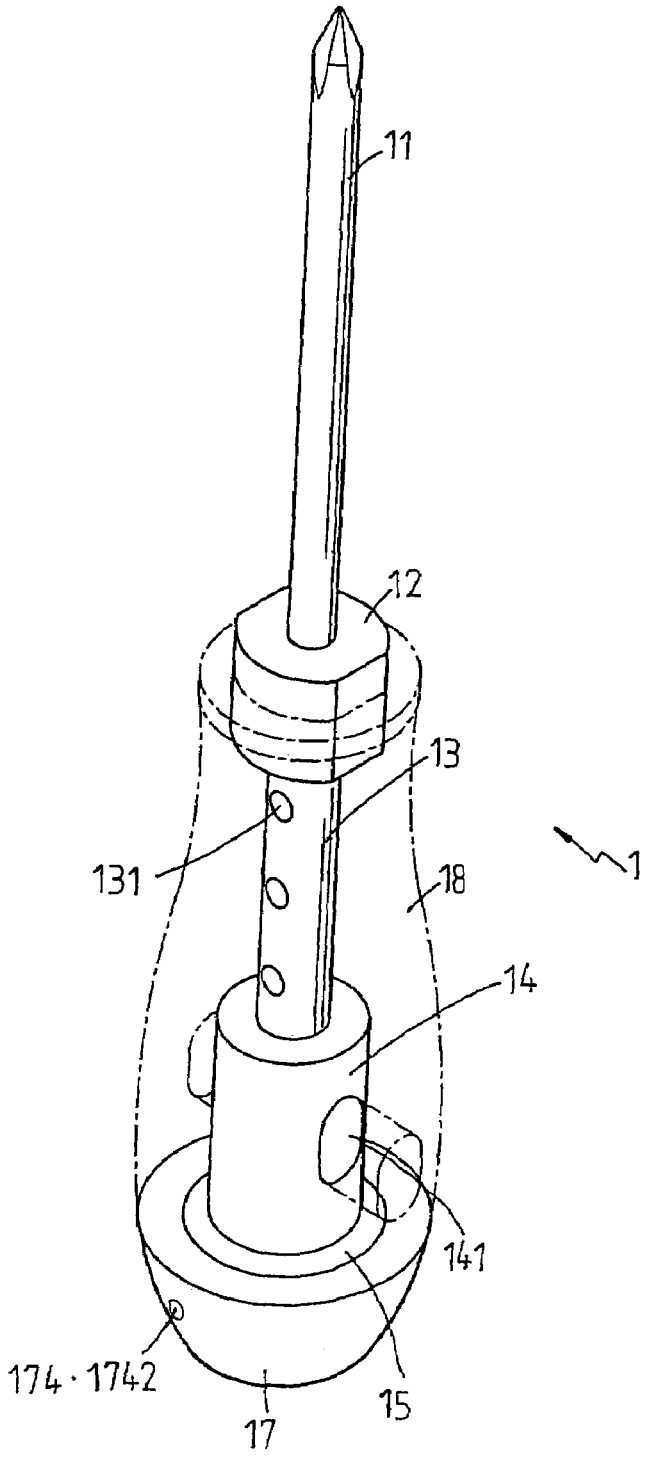
FIG. 2 is a perspective view of the rotary impact tool of the present invention.
Figure 3:
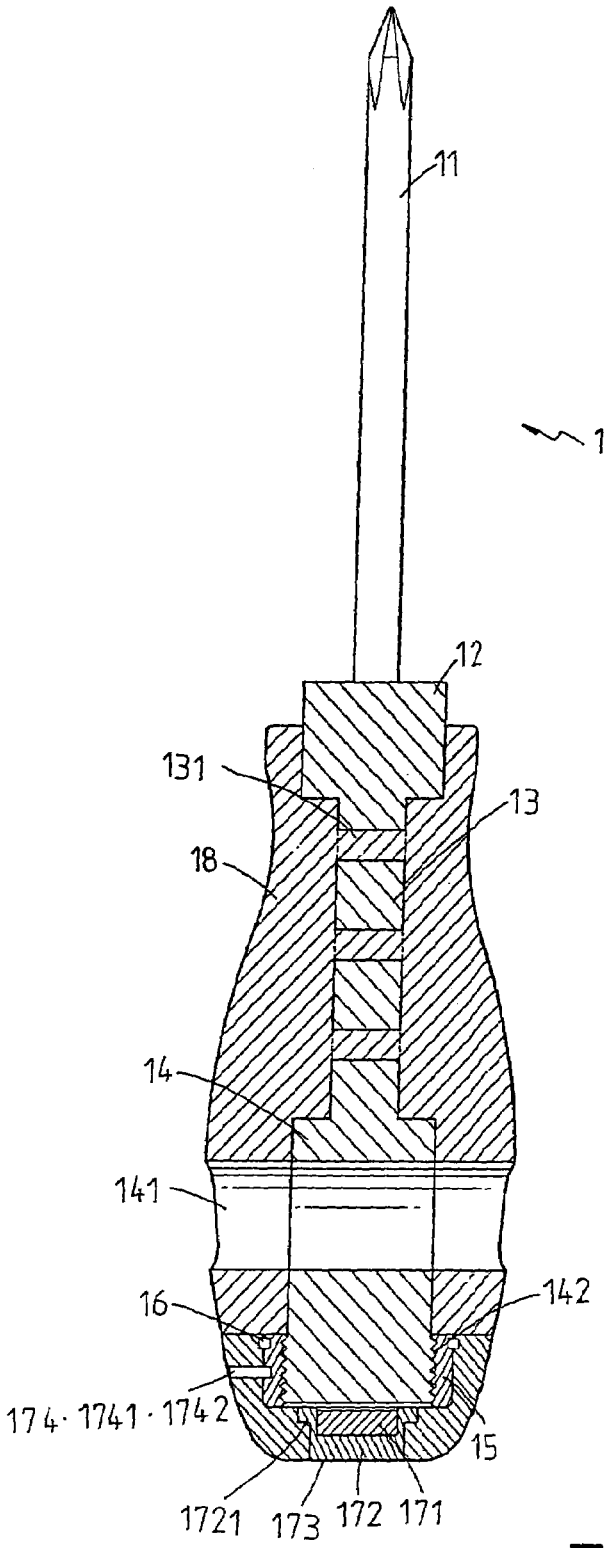
FIG. 3 is a schematic view of the rotary impact tool of the present invention.

Referring to FIGS. 2 and 3, the via holes of the body 13 serve to reduce the weight of the body 13. The body 13 and axial portion 14 are enclosed with flexible material (such as plastics) so as to form as a handle 18. The engaging unit 15 is made of hard plastics for reducing the weight. The plastics of the handle are filled in the via holes 131 so that the handle has a firm structure. The magnetic unit 171 is installed in the impact portion 17. The magnetic unit 171 is received in the stop unit 172. The flange 1721 resists against the receiving hole 173 of the impact portion 17 so that the magnetic unit 171 do not expose out from the impact portion 17. The stop unit 172 is made of metal. The magnetic field of the magnetic unit 171 will transmit through the stop unit 172 so as to have the effect of attraction. The impact portion 17 is made of metal. The impact portion 17 can suffer from the impact force of a hammer 2 and transfers the impact force to the driving portion 11 so as to have the affect of an impact tool. If the impact portion 17 deforms, the insertion unit 174 will penetrates through the impact portion 17 and the engaging unit 15 so that the impact portion 17 interacts with the engaging unit 15 and is detached from the axial portion 14 for updating. The elliptical resisting portion 12 is suitable for spanners of different sizes so as to drive a tool with a great arm of force.

Figure 4:
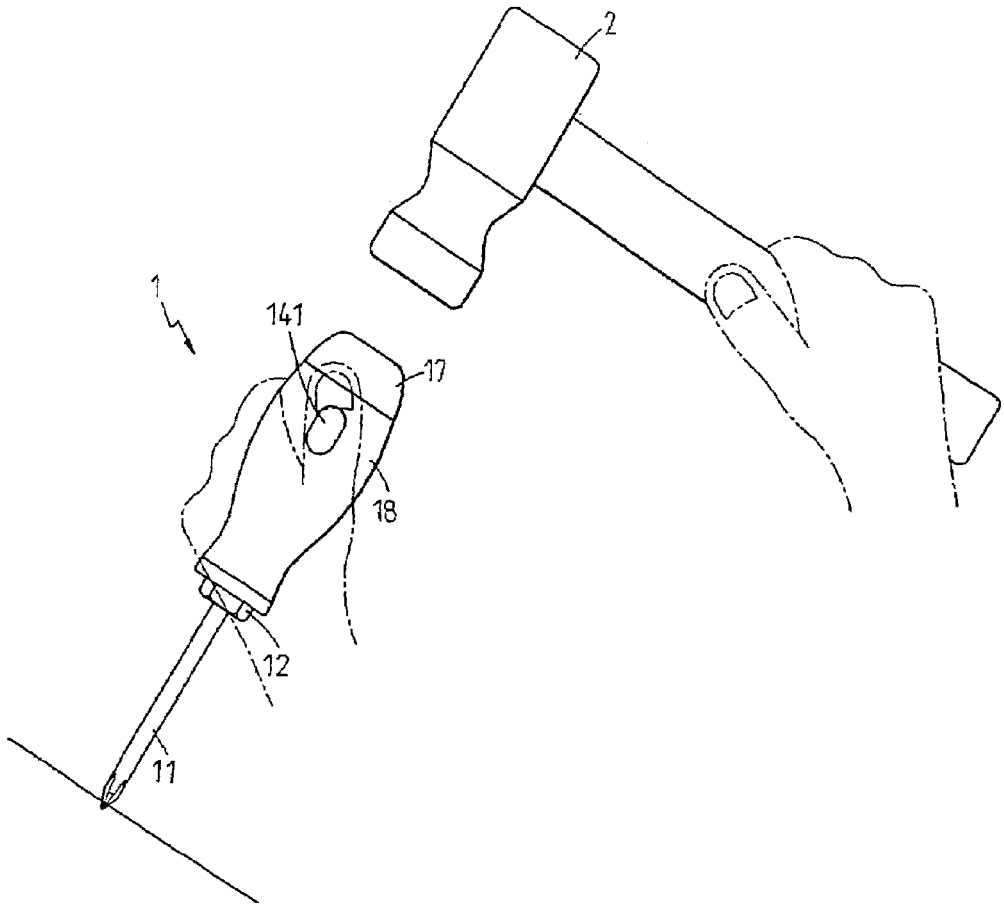
FIGS. 4-6 are schematic views showing the use of the present invention.
Figure 5:
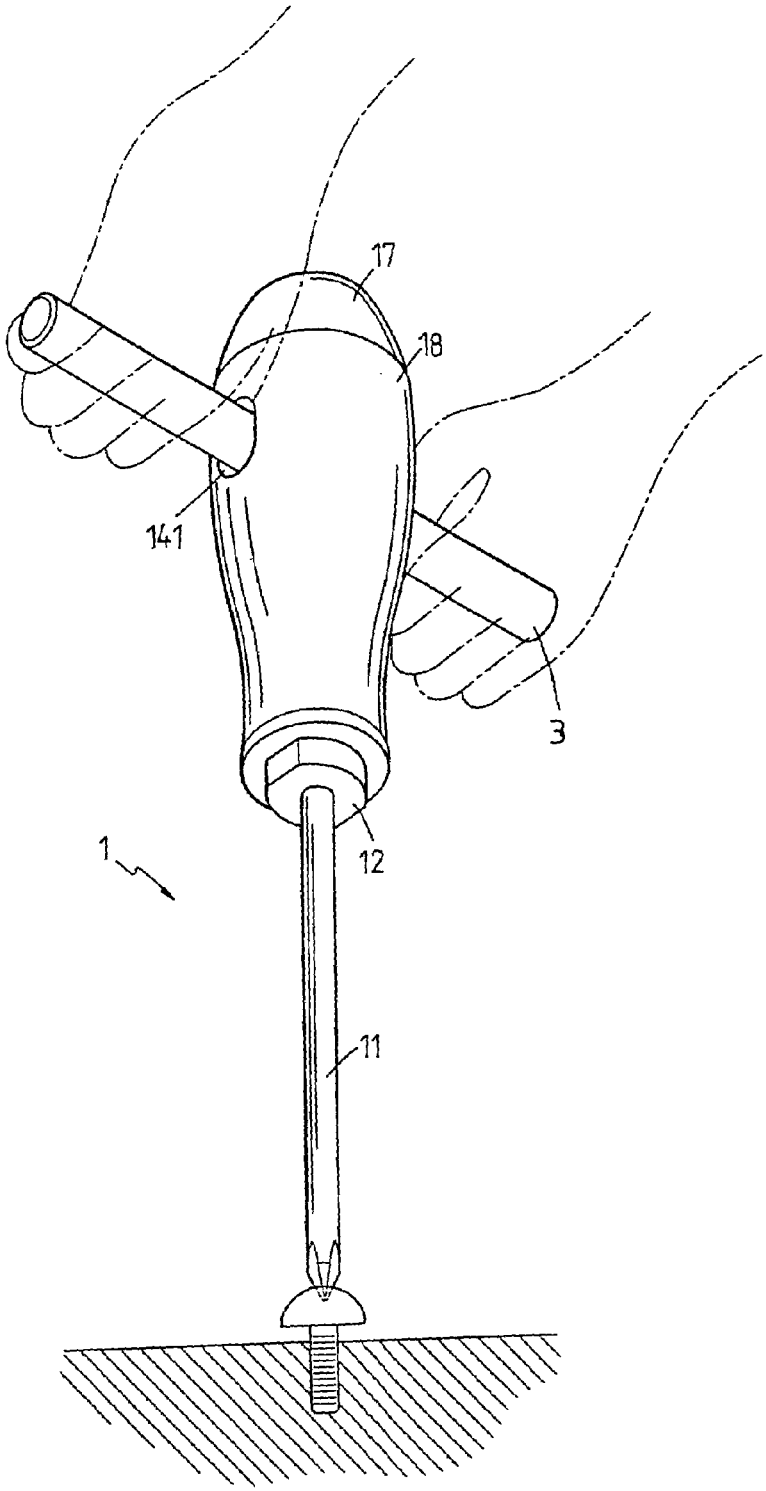
Figure 6:
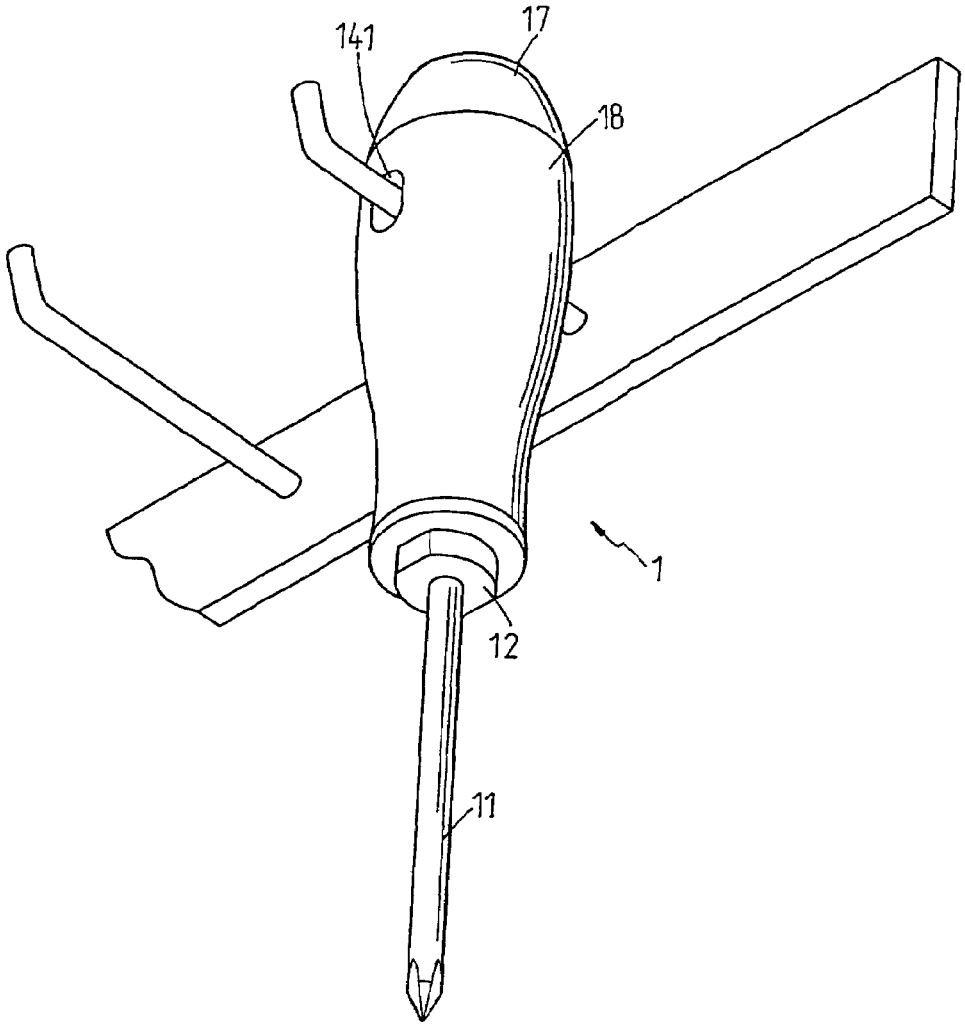

Referring to FIG. 4, one application of the present invention is illustrated. A handle 18 collides the impact portion 17 of the present invention. The via holes 131 has a buffer effect. Referring to FIGS. 5 and 6, the axial portion 14 is installed with the through hole 141 which is hollowed (not filled with plastics of the handle 18). A rod 3 can passes through the through hole 141 for providing a torque to the tool 1. See FIG. 6, when the tool 1 is not used, it can be hung on a plate.

Moreover, in the present invention the C ring 16 can be replaced by other buckle. The engaging unit 15 and stop unit 172 can be neglected in the present invention so that the impact portion 17 is directly pivotally installed to the axial portion 14. The impact portion 17 is magnetic and the receiving hole 173 may do not penetrate through the impact portion 17. The form of the resisting portion 12 is changeable.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A rotary impact tool comprising:

a driving portion;

a body extending from a lower side of the driving portion;

an axial portion extending from a lower side of the body; a through hole being formed in the axial portion for receiving a bar to provide an arm of force in operation; a lower periphery of the axial portion being formed with a thread portion an engaging unit engaged with the thread portion of the axial portion; in assembly, the axial portion being screwed to the engaging unit;

an impact portion; a lateral side of the engaging unit being formed with a first insertion hole for receiving an insertion unit; a lower side of the impact portion being formed with a receiving hole; a stop unit being received in the receiving hole; a lateral side of the impact portion being formed with a second insertion hole; and an insertion unit being received in the second insertion hole;

a flange extending from an upper periphery of the stop unit resting against an inner wall of the receiving hole of the impact portion so that a magnetic unit will not protrude out from the receiving hole;

a magnetic unit being received in the stop unit; and an upper inner wall of the impact portion being formed with the second insertion hole; the impact portion being rotatable with respect to the engaging unit; the engaging unit being combined with the axial portion so that the impact portion is rotatale with respect to the axial portion to form a pivotal rotatable impact portion; and wherein the engaging unit is screwed to the thread portion of the axial portion; the impact portion is rotatable with respect to the engaging unit;

when the insertion unit is received in the second insertion hole of the impact portion, the impact portion passes through the second insertion hole to be assembled to the first insertion hole so that the impact portion is combined with the engaging unit; when the engaging unit is screwed to the axial portion, if the user rotates the impact portion and thus the engaging unit rotates, the engaging unit, magnetic unit, and the impact portion can be screwed and detached.

2. The rotary impact tool as claimed in claim 1, wherein the driving portion is extended with a resisting portion at a lower side thereof; the resisting portion is an elliptical cylinder with two cut ends; the body is extending from a lower side of the resisting portion; an axial size of the body is smaller than that of the resisting portion.

3. The rotary impact tool as claimed in claim 1, wherein the body having a plurality of via holes for reducing the weight thereof.

4. The rotary impact tool as claimed in claim 1, wherein the engaging unit is formed with a first recess for buckling with a C ring; the impact portion is combined to the C ring; in assembly, the C ring encloses the first recess of the engaging unit.

5. The rotary impact tool as claimed in claim 1, wherein the body and axial portion are enclosed with flexible material so as to form as a handle and in assembly, the resisting portion resists against an upper surface of the handle.

6. The rotary impact tool as claimed in claim 5, wherein the engaging unit is made of hard plastics for reducing the weight and the plastics of the handle are filled in the holes of the body so that the handle has a firm structure; and the magnetic field of the magnetic unit will transmit through the stop unit.

* * * * *